United States Patent [19]

Beck et al.

[11] Patent Number: 5,011,815

[45] Date of Patent: Apr. 30, 1991

[54] THERMAL TRANSFER DYESHEET

[75] Inventors: Nicholas C. Beck, Manningtree; Peter A. Gemmell; Richard A. Hann, both of Ipswich, all of Great Britain

[73] Assignee: Imperial Chemical Industries plc, London, England

[21] Appl. No.: 433,785

[22] Filed: Nov. 9, 1989

[30] Foreign Application Priority Data

Nov. 11, 1988 [GB] United Kingdom ..... 8826456

[51] Int. Cl.[5] ..... B41M 5/035; B41M 5/26

[52] U.S. Cl. ..... 503/227; 8/471; 428/195; 428/913; 428/914

[58] Field of Search ..... 8/471; 428/195, 913, 428/914; 503/227

[56] References Cited

U.S. PATENT DOCUMENTS 4,746,646 5/1988 Nakanishi et al. ..... 503/227

*Primary Examiner*—Bruce H. Hess

*Attorney, Agent, or Firm*—Cushman, Darby & Cushman

[57] ABSTRACT

A method for improving the stability of a color print formed by dye-diffusion thermal transfer printing, comprises placing against the print a panel of transfer coat comprising a dye-absorbant binder which is substantially free from any thermally transferable materials, and heating at least those areas of the print to which one or more dyes have been transferred, thereby to cause absorption by said panel of dye molecules at the surface of the print. This may conveniently be carried out as part of the printing operation by using a dyesheet having a transfer coat comprising a plurality of uniform panels containing different colored thermally transferable dyes held in a dye-absorbant binder, and further panels comprising a dye-absorbant binder which is substantially free from any thermally transferable materials.

6 Claims, No Drawings

THERMAL TRANSFER DYESHEET

The invention relates to the production of coloured images by dye diffusion thermal transfer printing, and in particular to dyesheets for such processes and to their manner of use.

Thermal transfer printing ("TTP") is a generic term for processes in which one or more thermally transferable dyes are caused to transfer from a dyesheet to a receiver in response to thermal stimuli. For many years, sublimation TTP has been used for printing woven and knitted textiles, and various other rough or intersticed materials, by placing over the material to be printed a sheet carrying the desired pattern in the form of sublimable dyes. These were then sublimed onto the surface of the material and into its interstices, by applying heat and gentle pressure over the whole area, typically using a plate heated to 180°–220° C. for a period of 30–120 s, to transfer substantially all of the dye.

A more recent TTP process is one in which prints can be obtained on relatively smooth and coherent receiver surfaces using pixel printing equipment, such as a programmable thermal print head or laser printer, controlled by electronic signals derived from a video, computer, electronic still camera, or similar signal generating apparatus. Instead of having the pattern to be printed already preformed on the dyesheet, a dyesheet is used which comprises a thin substrate supporting a transfer coat comprising a single dye or dye mixture (usually dispersed or dissolved in a binder) forming a continuous and uniform layer over an entire printing area of the dyesheet. Printing is then effected by heating selected discrete areas of the dyesheet while the transfer coat is held against a dye-receptive surface, causing dye to transfer into the corresponding areas of that receptive surface. The shape of the pattern transferred is determined by the number and location of the discrete areas which are subjected to heating, and the depth of shade in any discrete area is determined by the period of time for which it is heated and the temperature reached. The transfer mechanism appears to be one of diffusion into the dye-receptive surface, and such printing process has been referred to as dye-diffusion thermal transfer printing ("DDTTP").

The heat for transferring the dyes can be supplied by printers having thermal printing heads which are pressed against that reverse surface of the dyesheet (or any overlying backcoat). Thermal printing heads have rows of tiny heaters, typically six or more to the millimetre, and these are actuated intermittently according to the electronic signals received by the printer, each to give an individual pixel of the required print (although some modern printers may have more than a single heater per pixel). As mentioned above, the electronic signals used to activate the printer may be from a video, electronic still camera or telefax machine, for example.

Presently available printers can only print one row of pixels at a time, so it is desirable to print them at high speed with short hot pulses, usually from near zero up to about 10 ms, but even up to a maximum of 15 ms in some printers, with each pixel temperature typically rising to about 350° C. during the longest pulses.

Typical receivers used for DDTTP, consist essentially of a sheet-like substrate coated with a dye-receptive layer of a composition having an affinity for the dye molecules and into which they can readily diffuse when the dyesheet is heated during printing.

Dyesheets generally consist essentially of a sheet-like substrate, such as paper or thermoplastic film, supporting on one surface (its obverse surface) at least a transfer coat comprising a thermally transferable dye, usually held in a polymeric binder. Additional coatings may also be present, including for example adhesive and/or dye-barrier subbing layers between substrate and transfer coat, and backcoats on the other (reverse) surface of the substrate for improving slip or heat resistance properties. The dyesheet may be elongated in the form of a ribbon and housed in a cassette for convenience, enabling it to be wound on to expose fresh areas of the transfer coat after each print has been made.

Dyesheets designed for producing multicolour prints have a plurality of panels of different uniform colours, usually three: yellow, magenta and cyan, although the provision of a fourth panel containing a black dye, has also previously been suggested. When supported on a substrate elongated in the form of a ribbon, these different panels may be provided as longitudinal parallel strips, but are more usually in the form of transverse panels, each the size of the desired print, arranged in a repeated sequence of the colours used. During printing, panels of each colour in turn are then placed on the receiver sheet and passed over the printing head to transfer its dye as required, this to be overprinted by each subsequent colour to make up the full colour image.

To enable prints to be made in this manner, the colours are provided by dyes which can diffuse into the receiver sheet when heated. Nevertheless, a freshly prepared thermal transfer print has a very high concentration of the transferred dyes on or just within the surface of the receiver sheet. This high surface concentration leads to various print stability problems. The high dye concentration provides a driving force for crystallisation, either induced by heat or the presence of grease on the receiver surface. Also, a greasy finger wiped across the print surface can cause smearing of the dyes. We have now found that this is especially a problem with the last dye to be transferred, normally the cyan, and that one of the reasons seems to be lack of removal of excess dye on the surface. Any transferred dye which remains at the surface of the receiver might be at risk of being reabsorbed by the binder of subsequent panels when the print becomes reheated during the transfer of subsequent colours, and we have found that by similarly re-absorbing the last colour to be transferred, we can significantly reduce the above problems.

According to a first aspect of the present invention, a dyesheet for thermal transfer printing comprises a substrate supporting a transfer coat comprising a plurality of uniform panels containing different coloured thermally transferable dyes held in a dye-absorbant binder, and further panels comprising a dye-absorbant binder which is substantially free from any thermally transferable materials.

We prefer that the composition of the further panel be essentially the same as that of each of the other panels with the exception of the dye. Printing conditions do not then need to be changed to suit changes in binder, for example.

According to a second aspect of the present invention, a method for improving the stability of a multicolour print formed by dye-diffusion thermal transfer printing, comprises placing against the print a panel of transfer coat comprising a dye-absorbant binder which is substantially free from any thermally transferable materials, and heating at least those areas of the print to which one or more dyes have been transferred, thereby to cause absorption by said panel of dye molecules at the surface of the print. By using a dyesheet according to the first aspect of the invention, the partial reabsorption can be effected very simply by causing the receiver to pass through the same printer once more, as though the additional panel contained another colour to be added to the print.

We prefer that substantially the whole area of the print be heated during the reabsorption step, including any areas which have not received any coloured dye during printing. This further reabsorption step can then more readily be programmed into the software of the printer, and hence be independent of any colour signals representing the individual colours. The percentage of dye molecules reabsorbed from the surface of the receiver can be controlled by varying the amount of heat applied, and to some extent the end result represents a trade-off between a highly stable print having very few dye molecules remaining on the surface, and a less stable print of higher colour density. However, by balancing the conditions of both the printing and reabsorption steps, it is possible to obtain more stable prints having colour densities very similar to those of untreated prints.

The dyesheet configuration we prefer is one wherein the substrate has an elongated ribbon shape, and the colours are arranged as a repeated sequence along the length of the ribbon, each sequence containing a uniform panel of each colour and a further panel without a dye. The preferred colours are yellow, magenta, cyan and optionally black (and thus are compatible with the present standard electronic colour signals), and with the further panel, these make a sequence of four different uniform panels, or five if black is present, this sequence being repeated along the ribbon.

EXAMPLE

A coating formulation was prepared from the following ingredients:

ethyl cellulose 3.75 g
toluene 22.5 g
methyl ethyl ketone 22.5 g

The above formulation was coated onto a subcoated surface of biaxially oriented polyester film substrate, using a No. 3 Meier bar, and then dried, giving a dry coat thickness of about 3 μm. The reverse surface of the substrate film also had a previously-applied protective back-coat.

The absorbant binder sheet thus prepared was placed against a thermal transfer receiver sheet which had been preprinted using a dyesheet in which the dyes were held in an absorbant binder of the above formulation. These were then passed through a printer programmed to actuate the heaters for all pixels. The resultant print was compared with one that had not received this further treatment. The treated print had a slightly lower colour density than the other, but had a surface that was more resistant to smearing. Microscopic examination showed that the excess on the surface had been removed.

A further print was prepared in a manner essentially as before, except that the gain on the printer was increased to transfer more dye to compensate for that lost in the above treatment, such that the colour density of the final treated print was similar to that of the untreated print. The colour fastness of the treated print was again superior to that of the untreated print.

We claim:

1. A dyesheet for thermal transfer printing, which has a substrate supporting a transfer coat comprising a plurality of uniform panels containing different coloured dye-diffusion thermal transfer printing dyes held in a dye-absorbent binder, characterised in that the transfer coat also has further panels comprising a dye-absorbent binder which is substantially free from any thermally transferable materials.

2. A dyesheet as claimed in claim 1, characterised in that the composition of the further panel is essentially the same as that of each of the other panels, with the exception that the dyes are absent.

3. A dyesheet as claimed in claim 1 or claim 2, characterised in that the substrate is elongated in the form of a ribbon, and the different panels are in the form of transverse panels arranged along the ribbon in a repeated sequence of the different colours and dye-free binder.

4. A method for improving the stability of a colour print formed by dye-diffusion thermal transfer printing, which comprises placing against the print, a panel of transfer coat supported on a substrate, the panel comprising a dye-absorbent binder which is substantially free from any thermally transferable materials, and heating at least those areas of the print to which one or more dyes have been transferred, thereby to cause absorption by said panel of dye molecules at the surface of the print.

5. A method as claimed in claim 4, characterised in that a dyesheet is used to form the colour print by thermal transfer printing, and to provide the panel of dye-free transfer coat for absorbing the dye molecules at the surface of the print, said dyesheet having a substrate supporting a transfer coat comprising a plurality of uniform panels containing different coloured dye-diffusion thermal transfer printing dyes held in a dye-absorbent binder, characterised in that the transfer coat also has further panels comprising a dye-absorbent binder which is substantially free from any thermally transferable materials.

6. A method as claimed in claim 4 or claim 5, characterised in that substantially the whole area of the print is heated during the step of dye absorption by the panel of dye-free transfer coat.

* * * * *